United States Patent [19]

Donahue

[11] Patent Number: 4,502,410

[45] Date of Patent: Mar. 5, 1985

[54] ENCLOSURE FOR TREATMENT TANK

[75] Inventor: Joseph D. Donahue, Troy, Mich.

[73] Assignee: Haden Schweitzer Corporation, Madison Heights, Mich.

[21] Appl. No.: 548,986

[22] Filed: Nov. 7, 1983

[51] Int. Cl.[3] ..... B05B 15/00; B05B 15/04

[52] U.S. Cl. ..... 118/429; 118/326; 118/DIG. 7; 52/79.12; 52/465

[58] Field of Search ..... 118/326, DIG. 7, 564, 118/429; 98/115 SB; 52/465, 79.12

[56] References Cited

U.S. PATENT DOCUMENTS

| | | | |
|---|---|---|---|
| 1,229,046 | 6/1917 | DeVilbiss | 118/DIG. 7 |
| 3,315,639 | 4/1967 | Close | 118/326 X |
| 3,942,420 | 3/1976 | Marino | 118/326 X |

*Primary Examiner*—Shrive P. Beck
*Attorney, Agent, or Firm*—Krass & Young

[57] ABSTRACT

An enclosure for phosphate, caustic and other chemical solutions in treatment tanks in automobile plants comprising a steel structure mounted on the peripheral flanges of the treatment tank and a completely non-corroding shell mounted internally of the steel structure to form the enclosure. The steel structure consists of I-beams having stainless steel anchor plates secured to the inner surfaces thereof and the enclosure structure comprises a plurality of fiberglass panels secured by clips to the anchor plates and sealed internally such as by caulking to completely shield the external steel structure from corrosive vapors and sprays.

10 Claims, 5 Drawing Figures

ENCLOSURE FOR TREATMENT TANK

INTRODUCTION

This invention relates to treatment facilities for metal workpieces such as automobile bodies and components of automobile bodies and most particularly to an improved enclosure for treatment tanks of the type in which phosphate solutions, caustic solutions, and other chemical solutions are employed by dipping and/or spraying to coat metal workpieces.

BACKGROUND OF THE INVENTION

Efforts to improve the finish and corrosion resistance of various products such as automobiles have resulted in the use of dip and spray tanks to precoat metallic articles with caustic solutions, phosphate solutions, and other chemical solutions prior to painting. It is necessary in the typical case to enclose these tanks to contain spray and/or to control evaporation and escape of vapors into the adjacent areas of the plant. Structural steel enclosures have been used for this purpose but have generally been unsatisfactory because of the tendency of the spray and vapors from the bath to attack the metal structural components of the enclosure. Even where non-corroding materials such as stainless steel have been used, the beams and other structural components of the enclosures are still exposed to the vapors and spray and eventually produce rust and maintenance problems. In addition, stainless steel is an expensive structural material.

Corrosion produces a number of problems including (1) the deterioration and unsightliness of the enclosure; (2) contamination of the bath or spray by corrosion containing condensate; and, (3) spoilage of the workpieces due to corrosion and corrosive materials falling thereon during the finishing operation.

It is theoretically possible to construct the entire enclosure from stainless steel but this is generally regarded as prohibitively expensive.

BRIEF SUMMARY OF THE INVENTION

In accordance with the present invention an improved enclosure structure for treatment tanks of the type having elongated laterally opposite and longitudinally extending upper peripheral flanges is provided, the thrust of the improvement being to produce an enclosure structure which is highly resistant to corrosion yet simple and inexpensive to construct, to dissassemble, to repair, and to alter in configuration.

In general, this is accomplished by constructing the enclosure so as to exhibit an external support structure of conventional materials and an internal shell of non-corroding materials such as fiberglass and stainless steel. In a specific embodiment designed to minimize the amount of stainless steel used, a plurality of generally U-shaped rigid metal bents are mounted at spaced intervals along the tank on the upper peripheral flanges thereof. Thereafter, a plurality of relatively narrow stainless steel anchor plates which face into the bath are secured such as by welding to the inner faces of the bents to protect the bents from direct contact with spray and vapor from the enclosed area. Thereafter, one secures to the anchor plates a plurality of reinforced resin (fiberglass) panels which form and finish the enclosure. The bents and the fastener devices which may be required to hold the structure together are all external of the fiberglass panels and stainless steel plates and hence are shielded from contact with the corrosive materials. A by-product advantage of the invention is the fact that the fiberglass panels may be constructed of relatively light translucent materials so as to dramatically improve the lighting conditions within the enclosure; a substantial benefit during maintenance operations.

DETAILED DESCRIPTION OF THE SPECIFIC EMBODIMENT

Figure 1:
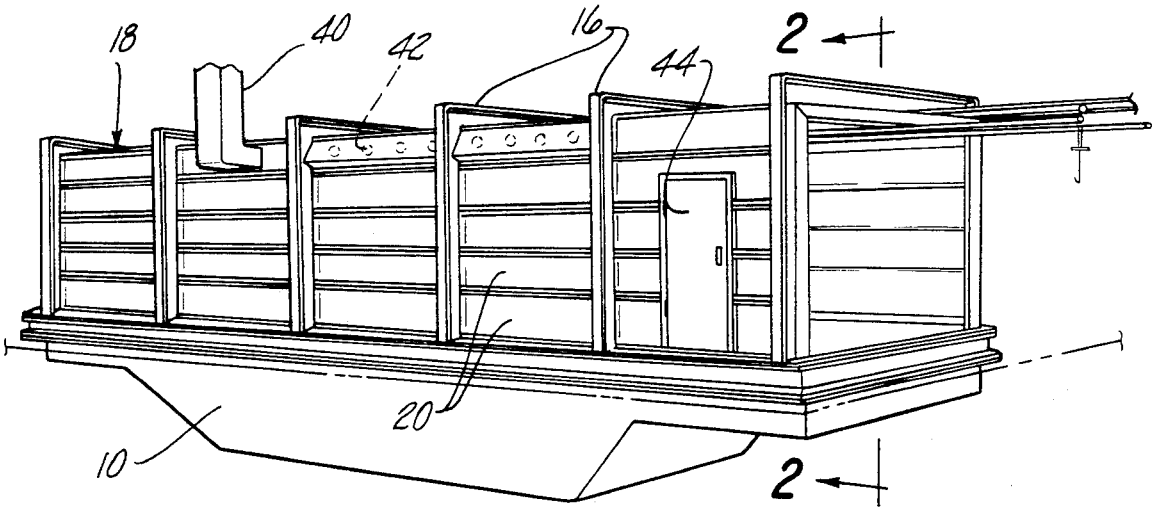
FIG. 1 is a perspective view of a treatment tank employing the subject invention.
Figure 2:
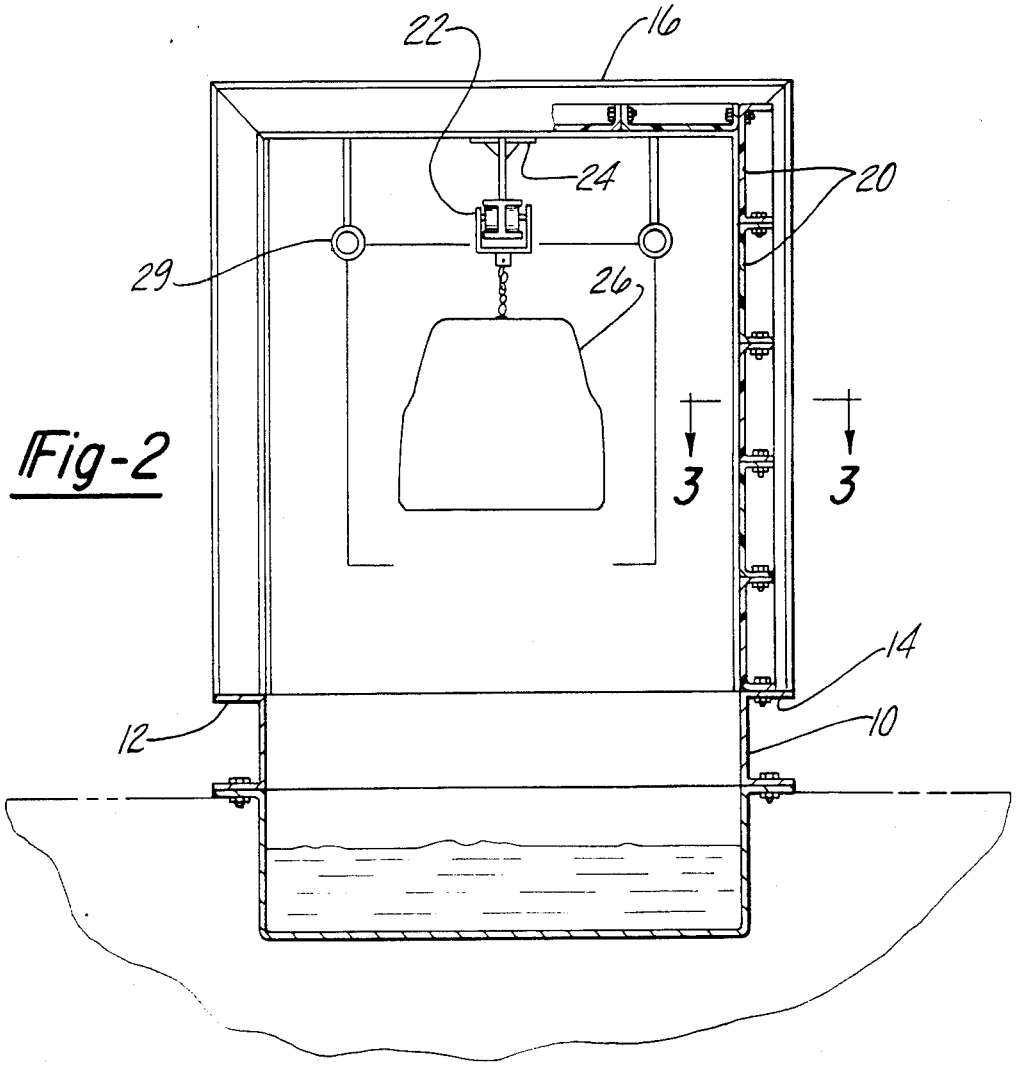
FIG. 2 is a detail of the enclosure structure taken along a section line 2–2 of FIG. 1.

Referring now to FIGS. 1 and 2, a specific and illustrative embodiment of the invention is shown in operative combination with a dip tank 10 of the type having upper and opposite peripheral edge flanges 12 and 14. Tank 10 is configured to permit dip coating of metal articles such as automobile bodies and automobile components and may be fully or partially recessed into a foundation as suggested in FIG. 2. While the illustrative embodiment of the invention deals with auto bodies, it is to be understood that the apparatus of the invention is also usable to treat such as by cleaning or coating any metal component or assembly.

The invention comprises an improved spray and vapor containing enclosure which rests on the flanges 12 and 14 of the tank and comprises a plurality of spaced U-shaped bents 16 constructed from conventional steel I-beams to form a support structure above the tank 10. An enclosure shell 18 of translucent fiberglass panels 20 is mounted within and supported by the outer structure consisting of I-beam bents 16 so that the corrosive sprays and vapors from the caustic, phosphate, or other chemical solution liquid bath within tank 10 contact only non-corrodible materials and are essentially maintained out of contact with the steel I-beam bents 16.

A chain conveyor 22 is mounted within the enclosure 18 by means of a stainless steel anchor plate 24 which is welded or otherwise suitably secured to and along the I-beam bents 16. A chain suspended from the conveyor 22 is provided with a suitable hook or other device for carrying metal parts such as an automobile body 26. Spray pipes 29 may extend the length of the enclosure 18 and parallel to the path of conveyor 22 for the purpose of spraying phosphates, caustic, or other chemical solutions onto the automobile bodies 26.

Figure 3:
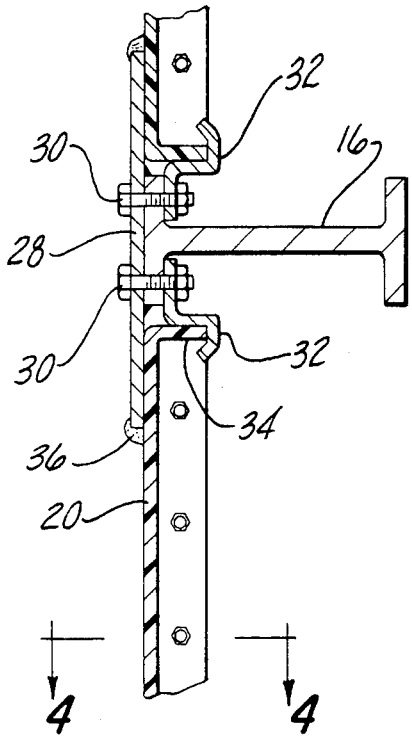
FIG. 3 is a section through the enclosure wall taken along section line 3—3 of FIG. 2.
Figure 4:
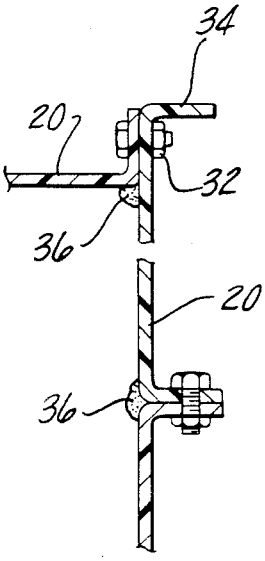
FIG. 4 is a sectional view showing a corner detail.
Figure 5:
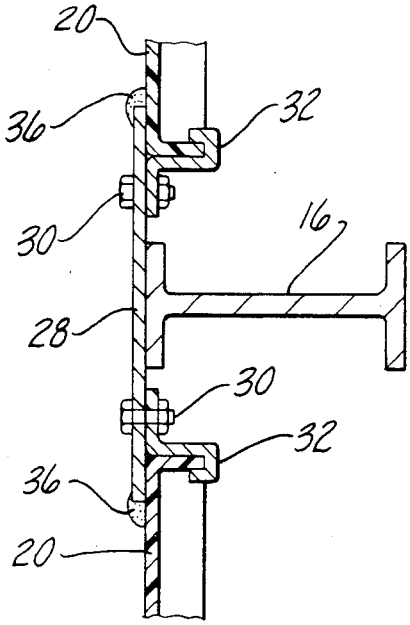
FIG. 5 is an alternative construction.

Referring now to FIGS. 3, 4 and 5, additional structural details of the enclosure system will be described. A stainless steel anchor plate 28 is welded to the interior face of each I-beam bent 16 or section thereof so as to face internally toward the bank enclosure and protect the face of the I-beam bent from contact with corrosive spray and/or vapor. Stainless steel bolts 30 are used to secure clips 32 to the anchor plates and, in the embodiment of FIG. 3, to the I-beam bent 16. Clips 32 are constructed of spring metal and are adapted to receive and secure to the outside faces of the stainless steel anchor plates 28 the fiberglass panels 20 so as to form the enclosure structure 18. Each of the panels 20 is molded so as to exhibit a peripheral flange 34 which fits onto the clip 32 for securement purposes. According to this construction technique, panels 20 may be put in place and/or removed with minimum difficulty. The panels 20 are preferably of a reasonably translucent character so as to transmit a fair amount of light into the interior of the enclosure 18.

FIG. 4 shows the detail of a longitudinal joint between flanges 34 of panels 20 and also a corner joint formed by abutment between edge 34 of one panel and the face of another panel 20 as shown. Stainless steel nut and bolt combinations are preferably used throughout. Again, however, other types of fasteners such as clips and clamps may be used.

Each joint or seam representing the intersection of a fiberglass panel 20 and either an anchor plate 28 or another fiberglass panel 20 is sealed with caulking material 36 of a type which attacks and chemically bonds to the resin of the fiberglass panels 20. This completely seals the external structural steel bents 16 from the corrosive vapors and sprays within the enclosure 18 and creates an essentially inside-out structure which virtually eliminates the corrosion problem associated with prior art treatment tank enclosures.

FIG. 5 illustrates an alternative to the structure of FIG. 3. In FIG. 5 the holes to receive the bolts 30 for the clips 32 are more widly spaced apart and extend only through the anchor plate 28 thereby eliminating the need to drill through the flange of the I-beam bent 16.

As shown in FIG. 1 stainless steel panels are provided for installation of ducts, door lights or other items which penetrate the enclosure.

I claim:

1. Apparatus for treating metal workpieces such as automobile bodies and automobile body components with a liquid, said apparatus being of the type which includes a tank having upper extremities on the opposite lateral walls thereof; an enclosure for said tank comprising:

a framework made up of a plurality of rigid bents mounted on said tank and extending in a generally U-shaped configuration over said tank and at spaced intervals therealong;

a plurality of anchor plates of non-corroding material secured internally of said bents; and a plurality of panels of non-corroding, non-metallic material secured to and extending between said plates to finish said enclosure and to isolate said bents from said liquid and vapors and sprays thereof.

2. Apparatus as defined in claim 1 wherein said panels are fiberglass and are secured externally of said plates.

3. Apparatus as defined in claim 2 wherein said plates are much narrower than the space between adjacent bents, the combination further including clip means secured to said plates and adapted to receive and removably secure said panels.

4. Apparatus as defined in claim 1 wherein said panels each comprise longitudinal edge flanges, the edge flanges of adjacent panels being in substantial abutment and secured together by mechanical fastener means.

5. Apparatus as defined in claim 4 including sealant means at the intersections of said plates and said panels.

6. Apparatus as defined in claim 1 wherein said bents are constructed of I-beams.

7. Apparatus as defined in claim 1 wherein said plates are constructed of stainless steel and are welded to said bents.

8. Apparatus as defined in claim 1 further including non-corrosive metal window panels extending between at least some of said adjacent bents.

9. Apparatus as defined in claim 1 including at least one non-corrosive door panel secured to at least one of said bents.

10. Apparatus as defined in claim 1 further including conveyor means suspended internally of said enclosure and from said bents.

* * * * *